US011234084B2

(12) United States Patent
Puder et al.

(10) Patent No.: US 11,234,084 B2
(45) Date of Patent: Jan. 25, 2022

(54) METHOD OF ADJUSTING THE RESPECTIVE PHASE RESPONSES OF A FIRST MICROPHONE AND A SECOND MICROPHONE

(71) Applicant: Sivantos Pte. Ltd., Singapore (SG)

(72) Inventors: Henning Puder, Erlangen (DE); Jens Hain, Kleinsendelbach (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 17/151,836

(22) Filed: Jan. 19, 2021

(65) Prior Publication Data

US 2021/0227337 A1 Jul. 22, 2021

(30) Foreign Application Priority Data

Jan. 17, 2020 (DE) ..... 102020200553.2

(51) Int. Cl.
*H04R 25/00* (2006.01)

(52) U.S. Cl.
CPC ..... *H04R 25/407* (2013.01); *H04R 25/405* (2013.01); *H04R 25/505* (2013.01); *H04R 25/604* (2013.01)

(58) Field of Classification Search
CPC ..... H04R 25/00; H04R 25/55; H04R 25/558; H04R 2460/01
USPC ..... 381/312–313, 316–320
See application file for complete search history.

(56) References Cited

U.S. PATENT DOCUMENTS

| | | | | |
|---|---|---|---|---|
| 7,254,245 | B2 | 8/2007 | Arndt et al. | |
| 7,587,058 | B2 * | 9/2009 | Fischer | H04R 25/407 381/23.1 |
| 2003/0198356 | A1 * | 10/2003 | Thompson | H04R 25/407 381/92 |
| 2004/0057593 | A1 * | 3/2004 | Pedersen | H04R 25/407 381/321 |
| 2007/0030990 | A1 * | 2/2007 | Fischer | H04R 25/453 381/318 |
| 2012/0057733 | A1 | 3/2012 | Morii et al. | |
| 2019/0281386 | A1 | 9/2019 | Geiger et al. | |
| 2019/0387328 | A1 | 12/2019 | Khing et al. | |

FOREIGN PATENT DOCUMENTS

EP 1458216 A2 9/2004

* cited by examiner

*Primary Examiner* — Suhan Ni
(74) *Attorney, Agent, or Firm* — Laurence A. Greenberg; Werner H. Stemer; Ralph E. Locher

(57) ABSTRACT

The phase responses of a first and a second microphone are adjusted with first and second filters that filter their microphone signals. The first filter corresponds to a first contribution to a phase shift between the microphones and includes a first adaptation parameter. The second filter corresponds to a second contribution to the phase shift and has a second adaptation parameter. A global filter, which is formed with the first and second filters, represents the first and second contributions to the phase shift and includes the first and second adaptation parameters. The global filter determines a first value for the first adaptation parameter and a second value for the second adaptation parameter via a multidimensional optimization. The phase responses are adjusted by applying the first filter and the second filter to at least one of the microphone signals with the adaptation parameters set to the first and second values, respectively.

14 Claims, 2 Drawing Sheets

METHOD OF ADJUSTING THE RESPECTIVE PHASE RESPONSES OF A FIRST MICROPHONE AND A SECOND MICROPHONE

CROSS-REFERENCE TO RELATED APPLICATION

This application claims the priority, under 35 U.S.C. § 119, of German patent application DE 10 2020 200 553.2, filed Jan. 17, 2020; the prior application is herewith incorporated by reference in its entirety.

BACKGROUND OF THE INVENTION

Field of the Invention

The invention relates to a method for adjusting the respective phase responses of a first microphone and a second microphone, the microphones being configured to generate a first and second microphone signal, respectively. A first filter for filtering the first microphone signal and/or the second microphone signal is determined, the first filter corresponding to a first contribution to a difference of the phase responses between the first microphone and the second microphone and comprising a first adaptation parameter. A second filter for filtering the first microphone signal and/or the second microphone signal is determined, the second filter corresponding to a second contribution to said difference of the phase responses and comprising a second adaptation parameter. For adjusting the phase responses, the first filter and the second filter are applied to the first microphone signal and/or to the second microphone signal with a first value for the first adaptation parameter and a with second value for the second adaptation parameter.

Microphones used in hearing aids or also in communication devices or systems typically comprise electroacoustic components such as, for example, membranes for converting the incoming sound into an electric signal, as well as, in the broadest sense, electronic components such as, for example, preamplifiers for the generated electric signal. These types of components often result in a non-trivial phase response in a microphone, which in most cases may be approximated by a high-pass. In systems with several microphones for a direction-dependent signal processing of sound, the phase responses of the individual microphones may differ from each other due to manufacturing tolerances of the components of the microphones, but also due to aging or dirt.

For a processing of the impinging sound signals by means of differential beamforming, however, a phase response as equal as possible for all involved microphones is required in order to guarantee the suppression performance of a differential microphone over the entire frequency range, if possible. Due to this reason, it is advantageous especially for beamforming applications to adjust the possibly different phase responses of two or more microphones to each other.

One possibility for adjusting the phase responses of two microphones consists in compensating for the influences of the electroacoustic and of the electronic components apart from each other by two different filters, which are applied to one of the generated microphone signals. To this end, each of the filters is adjusted for compensation of the respective difference in the phase responses which results from either the electroacoustic or the electronic components, respectively. Such an adjustment of one of the filters, however, always affects the other filter, since both filters model a respective high-pass behavior of the mentioned components of the microphones, with similar cutoff frequencies (approx. 60 Hz for the electroacoustic components and approx. 120 Hz for the electronic components) and with low slope steepness.

BRIEF SUMMARY OF THE INVENTION

It is accordingly an object of the invention to provide a method which overcomes a variety of disadvantages of the heretofore-known devices and methods of this general type and which provides for an improved method for adjusting the respective phase responses of a first microphone and a second microphone.

With the above and other objects in view there is provided, in accordance with the invention, a method of adjusting respective phase responses of a first microphone and a second microphone, wherein the microphones are configured to generate first and second microphone signals, respectively. The method comprises the following steps:

determining a first filter for filtering the first microphone signal and/or the second microphone signal, the first filter corresponding to a first contribution to a difference of the phase responses between the first microphone and the second microphone and having a first adaptation parameter;

determining a second filter for filtering the first microphone signal and/or the second microphone signal, the second filter corresponding to a second contribution to the difference of the phase responses and having a second adaptation parameter;

determining a global filter from the first filter and the second filter, the global filter representing the first contribution and the second contribution to the difference of the phase responses, and the global filter including the first adaptation parameter and the second adaptation parameter;

determining with the global filter a first value for the first adaptation parameter and a second value for the second adaptation parameter by way of a multidimensional optimization; and with the first adaptation parameter of the first filter having the first value and the second adaptation parameter of the second filter having the second value, adjusting the phase responses by applying the first filter and the second filter to the first microphone signal and/or to the second microphone signal.

In other words, the objects of the invention are achieved by a method for adjusting, in particular adaptively, the respective phase responses of a first microphone and a second microphone, the microphones being configured to generate a first and second microphone signal, respectively, wherein a first filter for filtering the first microphone signal and/or the second microphone signal is determined, said first filter corresponding to a first contribution to a difference of the phase responses between the first microphone and the second microphone and comprising a first adaptation parameter, wherein a second filter for filtering the first microphone signal and/or the second microphone signal is determined, said second filter corresponding to a second contribution to said difference of the phase responses and comprising a second adaptation parameter, wherein by means of the first filter and the second filter, a global filter is determined, said global filter representing the first contribution and the second contribution to said phase shift and comprising the first adaptation parameter and the second adaptation parameter, wherein by means of the global filter, a first value for the first adaptation parameter and, in particular at a time, a second value for the second adaptation parameter are determined via a multidimensional optimization, and wherein for adjusting the phase responses, the first filter and the second filter are applied to the first microphone signal and/or to the second microphone signal with the first value for the first adaptation parameter and with the second value for the second adaptation parameter, respectively. Particularly advantageous and inventive embodiments appear in the dependent claims and in the following description.

Preferably, two microphones of a hearing aid or of another communication equipment are used as a first and a second microphone. The first filter and the second filter are preferably determined in a way such that the respective contributions to the different phase responses, which are underlying to both filters, each may be compensated for by means of the first and second adaptation parameter via the corresponding filter, in case that the respective filter, according to its construction and design, is applied to the first microphone signal or the second microphone signal or to both microphone signals. Preferably, the first contribution and the second contribution to the differences of the phase responses represent physically different contributions, in particular an electronic and an electroacoustic contribution to the phase responses.

In other words, this means that each of the first filter and the second filter is being generated by means of a physical-electronic model in order to compensate for real physical differences in the phase responses of the microphones, wherein the first filter addresses a contribution to the phase response originating from different components than the contribution to the phase response that is being addressed by the second filter. Thereby, the first filter may be designed in a way such that it is configured to be applied either to the first microphone signal only, or to the second microphone signal only, or to both microphone signals for compensating for the differences in the phase responses which result from the components underlying to the first filter and the respective contribution. In particular, a similar configuration and an analogous reasoning may hold for the second filter. Preferably, the first filter is configured to be applied to only one microphone signal, and the second filter is also configured to be applied to only one microphone signal, and most preferably, both filters are configured to be applied to the same microphone signal.

In particular, the first filter and the second filter are determined, as described above, for the compensation of different contributions to the differences in the phase responses, wherein an isolated, i.e., a sole application of the first filter to the corresponding microphone signal according to the functioning of the first filter (or accordingly to both microphone signals) compensates exactly for the contribution to the differences in the phase responses which is underlying to the first filter. A similar configuration and an analogous reasoning may hold for the second filter. For the actual adjustment of the phase responses, both filters are applied to the corresponding microphone signal with the first and second value for the respective adaptation parameter, said first and second value to be determined in a way yet to be described.

By means of said both filters, and in particular, via their consecutive application, e.g., in frequency domain, or in z domain (i.e., in the discrete frequency domain for z-transformed, time-discrete signals), a global filter is determined, representing both contributions to the differences in the phase response, wherein said contributions preferably can be compensated for via said global filter. The global filter is determined by means of the first filter and the second filter in a way such that the first adaptation parameter of the first filter and the second adaptation parameter of the second filter are included as free parameters, which in particular is the case for a generation of the global filter by the aforementioned consecutive application of the two filters (or a consecutive application with an intercalation of further filters).

By means of the global filter, a first and a second value for the first and second adaptation parameter, respectively, are determined via a multidimensional optimization. In case that the global filter only comprises the first and the second adaptation parameter as free parameters, the optimization in particular may be performed in two dimensions with respect to said both adaptation parameters. The optimization may be applied directly to the global filter. Preferably, the global filter may be separated into a filter function independent of said both adaptation parameters and an effective global adaptation filter comprising the dependence of the global filter on both adaptation parameters, such that said multidimensional, and in particular, two-dimensional optimization in this case is applied to the effective global adaptation filter.

By means of said optimization, the first and the second value for the first and the second adaptation parameter, respectively, are determined. The first filter is then applied to the corresponding microphone signal (or to both microphone signals, if designed that way), i.e., the microphone signal provisioned according to the construction and functioning of the first filter, with the first value for the first adaptation parameter, and the second filter is applied to the corresponding microphone signal (or to both microphone signal, if designed that way) with the second value of for the second adaptation parameter, in order to compensate for the differences in the phase responses of the two microphones, and to adjust the phase responses.

This way, the adjustment may be performed in a particularly advantageous manner, because physically different contributions to the phase responses—and thus, differences in the phase responses resulting from said contributions—of the two microphones are not compensated for by two individually adapted filters which could lead the adaptation of one filter to have also an influence on the total behavior of the system, and thus, to the other filter. Rather, it is proposed to directly optimize a global filter, said global filter being constructed from two individual filters each of which representing different contributions, in a multidimensional algorithm, in order to determine globally optimal values for the respective adaptation parameters of the individual filters involved, and to operate these individual filters with said optimal values.

Preferably, the first filter is determined in a way such that the first contribution to the difference of the phase responses represents an electronic contribution to the phase responses, and/or the second filter is determined in a way such that the second contribution to the difference of the phase responses represents an electroacoustic contribution to the phase responses.

This in particular means that the second filter is determined in such a way that, by its application and by means of the second adaptation parameter, a contribution to the differences of the phase responses of the two microphones that can be compensated for, is being caused by electroacoustic components of the two microphones and in particular, by their differences in the two microphones, i.e., in particular by the membranes and their respective high-pass behavior. The second filter may in particular comprise one or several further parameters which model the frequency response resulting from the differences in the electroacoustic components. The frequency response of the electroacoustic components for each of the two microphones may be essentially described by a first order high-pass, which may be characterized in particular by a cutoff frequency (in the present case, in the range of 60 Hz for the electroacoustic components of each of the two microphones, respectively). The different behavior of the two microphones, which then may be modeled each by said high-pass, may be then compensated for by the application of the properly constructed second filter to one of the microphone signals or to both microphone signals. The cutoff frequency may be represented by said parameters in the second filter.

A similar configuration and an analogous reasoning may hold for the first filter with respect to the electronic components, which in particular comprise the output impedance and the preamplifier of each of the microphones. In particular, the first filter comprises one or several further parameters which model the frequency response resulting from the differences in the electronic components, wherein also the electronic components of each of the microphones in particular may be modeled by a high-pass with a cutoff frequency in the range of 120 Hz.

Conveniently, an in-phase sound signal having an equal phase with respect to the first microphone and the second microphone is provided to the first microphone and/or the second microphone, thereby generating a first test signal of the first microphone signal via the first microphone and/or a second test signal of the second microphone signal the second microphone, respectively, wherein the multidimensional optimization is performed by means of the first test signal and/or the second test signal, respectively. In particular, the first and the second test signal are generated such that for the implementation of the method, the corresponding test signal or both test signals may be processed by means of the two filters, and in particular, the global filter during optimization may be applied to the signal components of the corresponding test signal or of both test signals. Thus, the first microphone signal and the second microphone signal during optimization comprise signal components which, due to their aforementioned generation, do not show any phase differences, which is of particular advantage for adjusting differences in the phase response. The notion of an in-phase sound signal in particular comprises a sound signal whose sound source is located in the symmetry plane of the two microphones, or orthogonally to the connection line of the two microphones and in a distance to the symmetry plane which is neglectable with respect to the resulting acoustic runtime.

Advantageously, each of the first filter and the second filter changes only the first microphone signal. While for adjusting the phase responses, in principle, the first filter and the second filter may be determined in a way such that by the application of both filters, each of the two microphone signals is subjected to a change, it is of particular advantage to design the filters in a way such that only one microphone signal is changed by both filters, while in particular, the action of both filters onto the other microphone signal is trivial, since in this case the unchanged microphone signal may be used as a reference signal for the optimization.

Conveniently, the multidimensional, in particular two-dimensional optimization is implemented by means of a gradient descent algorithm, wherein a gradient with respect to a variation in direction of the first adaptation parameter and in direction of the second direction parameter is applied to an error function, which is determined by means of a deviation of the second microphone signal, being filtered with the global filter, from a reference signal. This in particular means that the global filter—and thus, the first and second filter—is applied to the second microphone signal, and a deviation of the second microphone signal, filtered as described, from a reference signal, e.g., from the first microphone signal, is determined.

An error function for the optimization is determined by means of said deviation, e.g., as a square of said deviation, and the gradient with respect to both of the adaptation parameters is applied to the error function. In particular, this may be implemented via the partial derivative of the error function with respect to the first and second adaptation parameter, respectively. By means of said gradient, in particular, correction values for the first and second value of the two adaptation parameters are determined, and the optimal values within the framework of the optimization are determined stepwise and in particular adaptively. In practice, this may be implemented, e.g., via a steepest descent algorithm or a diagonally scaled steepest descent algorithm.

In an advantageous embodiment, the first filter and the second filter are constructed in a way such that the global filter is separable into an infinite impulse response (IIR) filter contribution independent of the first adaptation parameter and the second adaptation parameter and a finite impulse response (FIR) filter contribution, wherein by means of the finite impulse response filter contribution in time domain, a filter polynomial of the first adaptation parameter and the second adaptation parameter is constructed, wherein the first value for the first adaptation parameter and/or the second value for the second adaptation parameter are updated in time domain, and wherein a step size of said update is constructed in dependence on the gradient applied to the filter polynomial. In particular, the gradient is constituted with respect to a variation in direction of the first adaptation parameter and in direction of the second adaptation parameter.

This in particular means that the first filter and the second filter, according to the contributions to the difference in the phase responses, shall be designed in a way such that the resulting global filter shows the form as described above, i.e., it is separable into an IIR filter contribution without any dependence on the two adaptation parameters and an FIR filter contribution including the entire dependence on the two adaptation parameters. By means of the FIR filter contribution, which in particular may be identified in frequency domain or z domain, the filter polynomial of the first adaptation parameter and of the second adaptation parameter is derived in time domain, e.g., by ordering the contributions in inverse powers of z (in z domain). The first value and/or the second value for the first and the second adaptation parameter, respectively, are then updated in time domain, which also shall comprise the discrete time domain, wherein for each update step (per time unit), a step size which depends on the gradient applied to said filter polynomial shall be used.

In particular, this results from the form as described above for the global filter: when applying the gradient to the error function described above, which in turn represents a function of the deviation of the "globally filtered" second microphone signal from the first microphone signal, the gradient is applied to said deviation and, in the end, to the globally filtered second microphone signal. If the global filter is separable, as described above, into an IIR filter contribution and an FIR filter contribution including the entire dependence of the global filter on the two adaptation parameters, the application of the gradient to the error function in (possibly discrete) time domain, in the end, results in an application of the gradient (with respect to the adaptation parameters) to the filter polynomial.

Advantageously, the step size in the respective direction of the first adaptation parameter and of the second adaptation parameter is normalized with respect to said deviation. Such a normalization improves the convergence properties of the adjustment, since in particular, this way an overshoot over an optimum due to a step size chosen too large may be prevented. The normalization may in particular be implemented via the modulus square of the gradient, applied to the deviation.

Conveniently, the respective normalization is regularized in dependence on the error function. Especially when the deviation of the globally filtered second microphone signal from the first microphone signal is showing only little changes per time unit (e.g., per discrete time step) with respect to the two adaptation parameters (upon increasing convergence towards an optimum), a regularization is advantageous in order to avoid a small denominator in case of a small norm causing large correction values, which may not be reliable when calculated in dependence on very small signals.

Preferably, for adjusting the phase responses, additionally, a parameter is used which takes into account a different loudness sensitivity of the first microphone and the second microphone. Differences in the loudness sensitivities between the two microphones, which on the one hand, may be compensated for apart from the differences in the phase responses, on the other hand still may influence the adjustment of the phase responses, so that taking into account the different loudness sensitivities may be useful.

It proves to be of further advantage if the phase responses of two microphones of a hearing aid are adjusted. In hearing aids with two or more microphones, beamforming methods are often applied, in particular for noise suppression, as well as for other improvements of a signal-to-noise ratio. Especially for differential beamforming, a behavior as identical as possible of the involved microphones with respect to their amplitude and phase responses is desired in order to avoid runtime or loudness differences being only caused by the different behavior of the microphones when determining, e.g., a direction of a sound source. For this reason, the present method for adjusting the phase response of two microphones of a hearing aid is particularly useful.

The notion of a hearing aid shall be understood as a device which is configured and used for supporting a hearing impaired person or for any other compensation of a hearing impairment, and in which, in dependence on the hearing impairment, an impinging sound is processed and in particular amplified in frequency bands, such that the signal, which has been processed according to the individual requirements of the user of the hearing aid, is presented to the hearing of the user via an output transducer.

The invention furthermore discloses a system comprising a first microphone and a second microphone, which are configured to generate a first microphone signal and a second microphone signal, respectively, and further comprising a control unit configured to perform the method for adjusting the respective phase responses of the first microphone and the second microphone according to one of the preceding claims. The system according to the invention shares the benefits of the method according to the invention. The advantages of the proposed method and of its preferred embodiments can be transferred to the system itself in a straight-forward manner.

The system in particular may be given by a hearing aid or a communication device, which may respectively comprise a control unit for performing the method. In particular, said control unit for performing the method is given by a control unit controlling operational functions during the operation as intended of the hearing aid or the communication device, respectively. Preferably, the system is configured to identify a sound suitable for performing the method by means of the first and the second microphone signal, e.g., via a corresponding arrangement of the control unit. However, the system particularly may comprise an own sound source configured to provide a sound signal suitable for performing the method to the first microphone and to the second microphone.

In particular, the system further comprises a sound source configured to provide a a diffuse sound signal and/or an in-phase sound signal to the first microphone and/or to the second microphone, said in-phase sound signal having an equal phase with respect to the first microphone and the second microphone. Such a sound signal is particularly suited for performing the method.

Preferably, the first microphone and the second microphone are disposed in a hearing aid. This in particular means that the system is given by a hearing aid, or the system comprises y hearing aid. In the first case, the hearing aid is configured, e.g., via a signal processor which also implements said control unit, to perform the method by means of an external sound signal, if such an external sound signal is identified as suitable for the method. In the second case, the system in particular may be given by a testing environment for the hearing aid and said hearing aid itself, wherein the testing environment comprises a sound source for generating a sound signal suitable for performing the method. The control unit may be implemented by a control unit of the hearing aid or by a control unit apart from the hearing aid. The system also may be given by a hearing aid and an external device which features the control unit, e.g., a mobile telephone connectable to the hearing aid for data transfer.

Other features which are considered as characteristic for the invention are set forth in the appended claims.

Although the invention is illustrated and described herein as embodied in a method for adjusting the respective phase responses of a first microphone and a second microphone, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

Parts and variables corresponding to one another are provided with the same reference numerals in each case of occurrence for all figures.

DETAILED DESCRIPTION OF THE INVENTION

Figure 1:
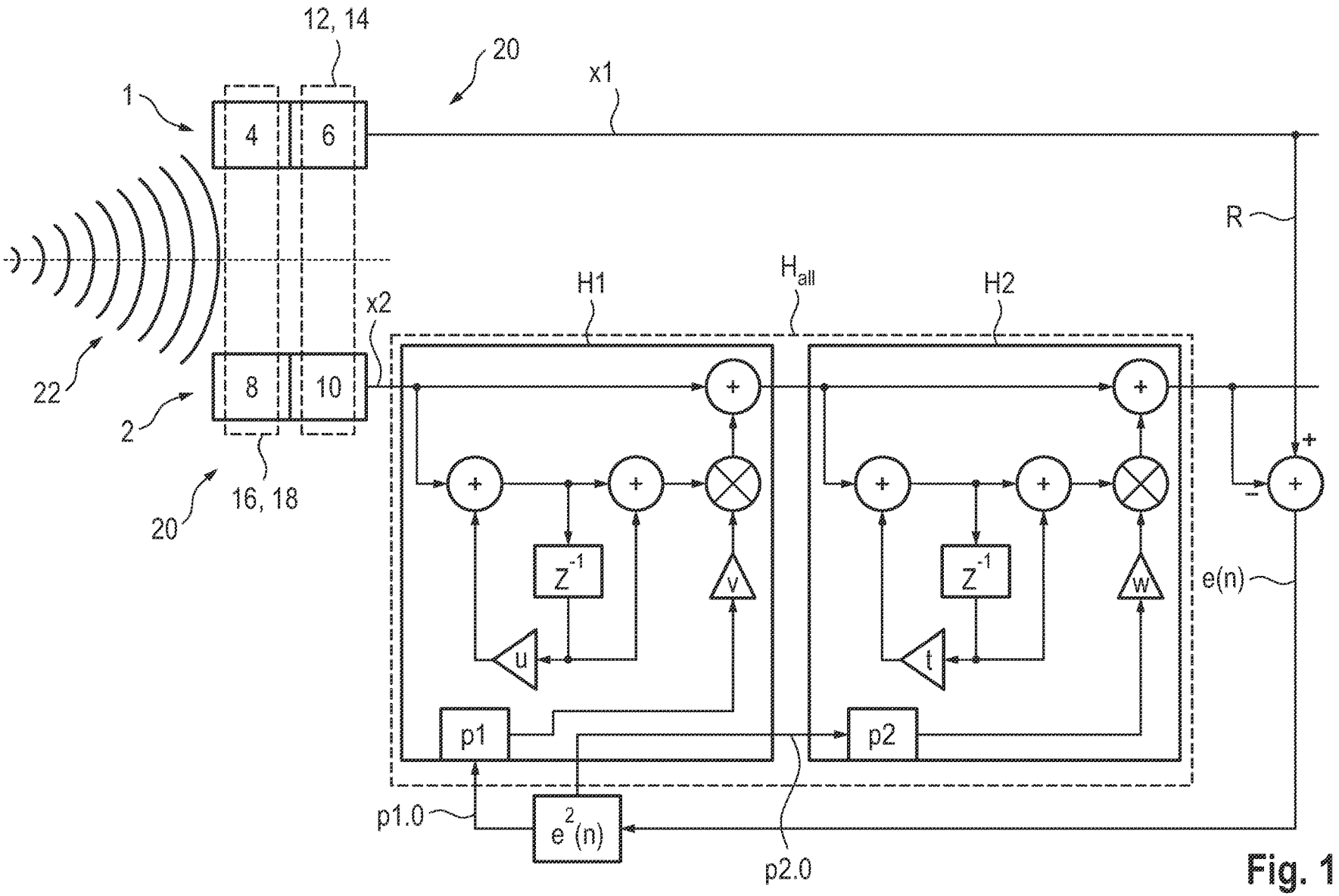
FIG. 1 is a schematic block diagram of a system with two microphones and two filters for adjusting the phase responses of the two microphones, according to the invention.

Referring now to the figures of the drawing in detail and first, in particular, to FIG. 1 thereof, there is shown a schematic block diagram with a first microphone 1 and a second microphone 2. The first microphone 1 and the second microphone 2 are configured to generate a first microphone signal x1 and a second microphone signal x2, respectively, from a sound signal not shown in detail. The first microphone 1 comprises electroacoustic components 4 which, e.g., may comprise a membrane of the first microphone 1, as well as (possibly contrary to other conventional definitions) first electronic components 6, which among others comprise a preamplifier. In an analogous way, the second microphone 2 comprises second electroacoustic components 8, as well as second electronic components 10. In the present embodiment shown, the first microphone 1 and the second microphone 2 are identically constructed, i.e., the first and second electroacoustic components 4, 8, on the one hand, as well as the first and second electronic components 6, 10, on the other hand, are each of identical building type, respectively.

Due to manufacturing tolerances or also due to aging, the first electroacoustic components 4 may show a different phase response than the second electroacoustic components 8. Likewise, the first electronic components 6 may show a different phase response than the second electronic components 10. Said electronic components 6, 10, thus, provide a first contribution 12, which in the present embodiment is given by an electronic contribution 14, to a difference in the phase responses of the two microphones 1, 2. In an analogous way, the electroacoustic components 4, 8 provide a second contribution 16, which in the present embodiment is given by an electroacoustic contribution 18, to the difference in the phase responses of the microphones 1, 2.

A system 20 comprising the two microphones 1, 2 is configured to compensate for the differences of the phase responses of the two microphones 1, 2. To this end, the system 20 comprises a first filter H1 and a second filter H2. The first and second filter H1, H2 are applied only to the second microphone signal x2 (a possible application of either of the filters H1, H2, to the first microphone signal x1, thus, results in the identity operation). A different implementation of the two filters H1, H2, such that each of the filters is applied to a different microphone signal x1, x2, or that each of the filters is applied in a non-trivial way to both of the microphone signals x1, x2, is also possible.

The first filter H1 comprises a first adaptation parameter p1, and is constructed in a way such that by means of the first filter H1, the electronic contribution 14 to the differences in the phase responses of the two microphones 1, 2 can be compensated for via a suitable value for the first adaptation parameter p1. To this end, the first filter H1 furthermore comprises two further parameters v, u, which adjust the phase response of the filter to the electronic contribution 14. The cutoff frequency in the present case is at approximately 120 Hz, while the transition band has a bandwidth of several tens of Hz.

In an analogous way, the second filter H2 comprises a second adaptation parameter p2, such that by means of the second filter H2, the electroacoustic contribution 18 to the differences in the phase responses of the two microphones 1, 2, may be compensated for via a suitable value for the second adaptation parameter p2. In a similar way to the first filter H1, the phase response of the second filter H2 can be adjusted to the electroacoustic contribution 18 via two further parameters w, t, while the cutoff frequency is at approximately 60 Hz. The second filter, H2, thus, is equal to the first filter H1 with the exception of the respective adaptation parameters p1, p2 and the other mentioned parameters involved.

In the z domain, the first filter H1 may be described by the transfer function $$H1(z) = \frac{[1 + p1v] + [p1v - u]z^{-1}}{1 - uz^{-1}}$$

with parameters v, u which characterize the frequency response of the first filter H1, and which accordingly may be chosen for adjusting the filter to the electronic contribution 14 to the differences of the phase response of the two microphones 1, 2. Therein, the argument z refers to the z transform of the input signal to the first filter H1, i.e., to the second microphone signal x2 in z domain. The second filter H2 may be described accordingly by the transfer function $$H2(z) = \frac{[1 + p2w] + [p2w - t]z^{-1}}{1 - tz^{-1}}$$

with parameters w, t which characterize the frequency response of the second filter H2, and which accordingly may be chosen for adjusting the filter for the electroacoustic contribution 18 to the differences of the phase response of the two microphones 1, 2.

Figure 2:
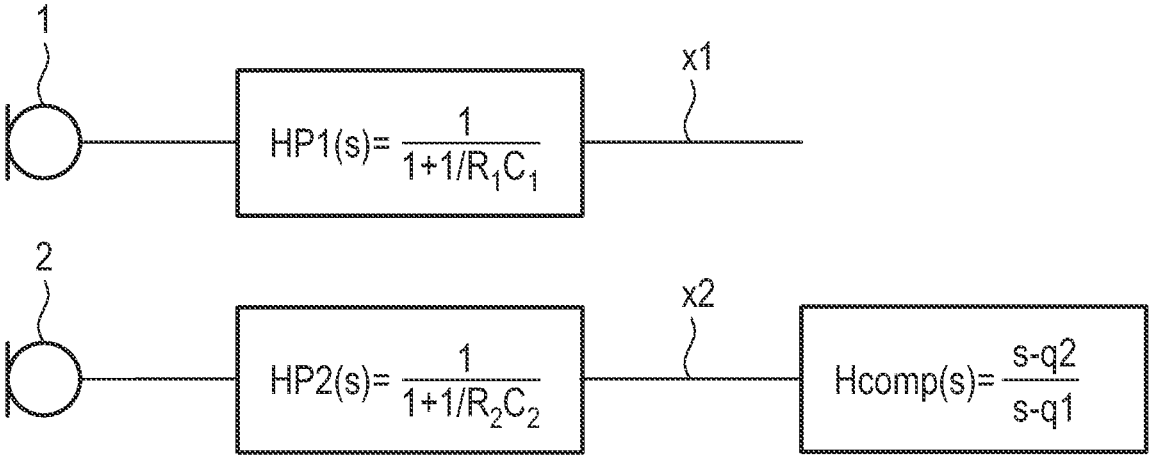
FIG. 2 represents an equivalent circuit diagram for the different high-pass behavior of the two microphones shown in FIG. 1 and for a corresponding compensation.

The exact form of the first and second filters H1($z$), H2($z$) is motivated by the high-pass property of the respective electronic and electroacoustic contributions 14, 18 for each microphone 1, 2, which is explained with reference to FIG. 2 by means of generic high-passes for each of the microphone signals x1, x2:

The electroacoustic or electronic components of the first microphone 1 are modeled by a first high-pass HP1, the corresponding electroacoustic or electronic components of the second microphone 2, respectively, are modeled by a second high-pass HP2. In order to compensate for the differences of the two high-passes HP1, HP2, as they result in the phase responses of the two microphones 1, 2, the second microphone signal x1 is filtered with a compensation filter Hcomp of the form Hcomp=HP1/HP2, such that the second microphone signal x2 filtered in the described way is being processed with the same high-pass behavior HP1 which is also experienced (intrinsically) by the first microphone signal x1. When representing the two high-passes HP1, HP2 via corresponding RC circuits, the resulting form of the compensation filter Hcomp is:

$$HP1(s) = \frac{s}{s + \frac{1}{R_1 C_1}},$$

$$HP2(s) = \frac{s}{s + \frac{1}{R_2 C_2}} \Longrightarrow Hcomp(s) = \frac{s - q2}{s - q1}$$

with qj=−1/(Rj·Cj). It should be noted that the high-passes HP1, HP2 are simply modelling the real behavior of the microphones 1, 2.

By means of the bilinear transform $$s = \frac{2}{T}\frac{1-z^{-1}}{1+z^{-1}}$$

into z domain (T denoting the sampling period or inverse sampling frequency), the form of the compensation filter may be represented, after grouping the individual terms by their order of $z^{-1}$, as $$Hcomp(z) = \frac{1 - Tq2/2 + (-1 - Tq2/2)z^{-1}}{1 - Tq1/2 + (-1 - Tq1/2)z^{-1}}.$$

Expanding (i.e., multiplication of the denominator and the numerator) by $(1-T\ q1/2)^{-1}$ and using the corresponding approximation $(1-T\ q1/2)^{-1} \approx 1+T\ q1/2$ for small arguments T q1/2 (which is justified due the time scale of T and the expectable values for q1, i.e., for R1 and C1), yields (only leading terms in T·q1):

$$Hcomp(z) = \frac{1 + T(q1 - q2)/2 + (-1 - Tq1/2 - Tq2/2)z^{-1}}{1 - (1 + Tq1)z^{-1}}$$

By using the definitions $u := 1 + Tq1$ and $p1 \cdot v := T(q1 - q2)/2$ with the scaling factor v and the adaptation parameter p1, the compensation filter Hcomp(z) finally may be brought to the form given above for the first filter H1(*z*) (or to the respective form given above for the second filter H2(*z*) by using p2 as the adaptation parameter, was the scaling factor as well as t instead of u). The application of the compensation filter Hcomp(s) to the second microphone signal x2, thus, compensates the latter for the differences of the two high-passes HP1 and HP2, which result from the behavior of the two microphones 1, 2, and for the resulting differences in the phase response.

In order to adapt the first adaptation parameter p1 and the second adaptation parameter p2, i.e., in order to determine a first value p1.0 and a second value p2.0 for the first and the for second adaptation parameter p1, p2, respectively, with which the first and the second filter H1, H2 shall be applied to the second microphone signal x2 for adjusting the phase responses of the two microphones 1, 2, an error function $e^2$ (n) shall be derived in dependence on the two filters H1, H2 in a way yet to be described, said error function $e^2$ (n) being optimized by a gradient descent, wherein the gradient is determined with respect to the first and the second adaptation parameters p1, p2. An update of the first and of the second adaptation parameter p1, p2 (i.e., of the vector p of the two adaptation parameters p1, p2) is carried out with a step size depending on said gradient.

For the error function $e^2$ (n), first of all, a global filter $H_{all}$ is constructed by means of a consecutive application of the first filter H1 and the second filter H2, which may be represented by following transfer function:

$$H_{all}(z) = \frac{([1 + p1v] + (p1v - u]z^{-1})([1 + p2w) + [p2w - t]z^{-1})}{(1 - uz^{-1})(1 - tz^{-1})}$$

Again, the argument z is given by the second microphone signal x2 in z domain. The second microphone signal x2, after being filtered with the global filter $H_{all}$, is then subtracted from a reference signal R, which is given by the (unfiltered) first microphone signal x1. From this, a deviation e (n) of the "globally filtered" second microphone signal x2 from the first microphone signal x1 gets apparent, and its modulus square $e^2$ (n) is determined as said error function $e^2$ (n), to be optimized with respect to the two adaptation parameters p1, p2 by the gradient descent algorithm.

Figure 3:
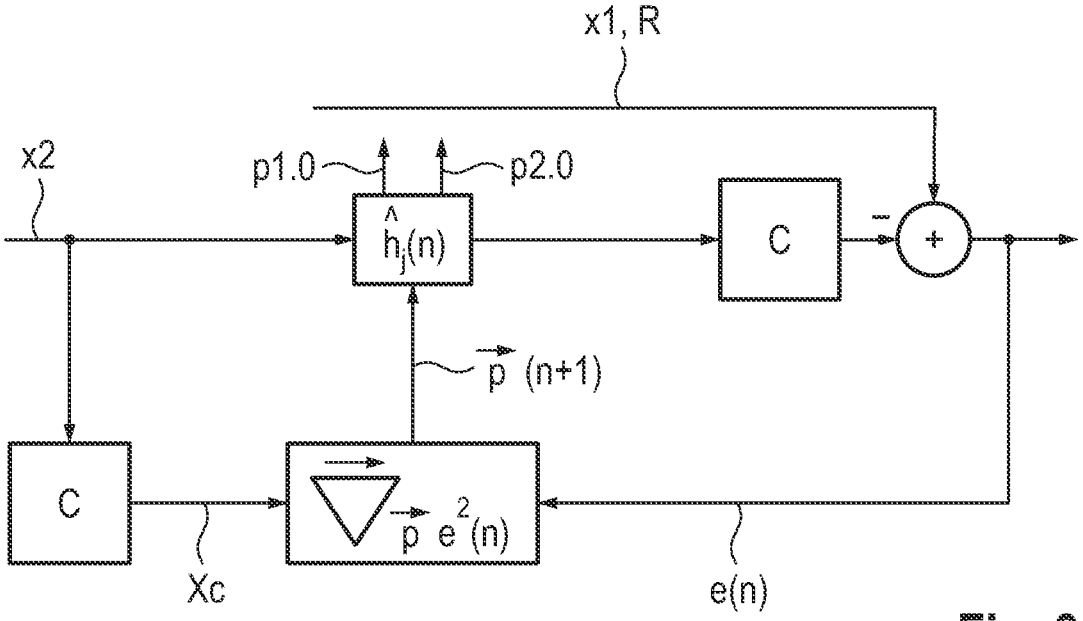
FIG. 3 is a block diagram, the adaptation of a global filter resulting from the two filters shown in FIG. 1.

In order to determine the step size for updating the two adaptation parameters p1, p2 via the corresponding gradient to be applied, as it is shown in FIG. 3 in a schematic block diagram, the global filter $H_{all}$ is separated into an IIR filter contribution C and an FIR filter contribution $\hat{H}$, the latter containing the entire dependence of the global filter $H_{all}$ on the two adaptation parameters p1, p2.

The transfer functions for the IIR filter contribution C and for the FIR filter contribution $\hat{H}$ arise from the respective denominator and enumerator of the transfer function given above for the global filter $H_{all}$ (z), i.e.:

$$C(z) = \frac{1}{(1 - uz^{-1})(1 - tz^{-1})}$$

$$\hat{H}(z) = ([1 + p1v] + [p1v - u]z^{-1})([1 + p2w] + [p2w - t]z^{-1})$$

As it can be seen from FIG. 3, the application of the gradient in direction of p (i.e., in direction of the two adaptation parameters p1, p2) to the deviation e(n)=x1(*n*)−$H_{all}$(n)*x2(*n*) (for determining a step size for an update of p1 and p2; the convolution of the global IIR filter $H_{all}$(n) with the second microphone signal x2(*n*) as the target signal for compensation being performed in time domain) results in an application of said gradient to a (vector-valued) filter polynomial $\hat{h}$ (n). This filter polynomial $\hat{h}$ (n) is given by the polynomial in p1 and p2 in (discrete) time domain corresponding to the FIR filter contribution $\hat{H}$ (z), wherein the vector entries $\hat{h}_j$(n)(j=1, 2, 3) can be derived from $\hat{H}$ (z) by ordering the inverse powers of z:

$$\begin{bmatrix} h_1 \\ h_2 \\ h_3 \end{bmatrix} = \begin{bmatrix} (1 + \widehat{p1}\,v)(1 + \widehat{p2}\,w) \\ (1 + \widehat{p1}\,v)(\widehat{p2}\,w - t) + (1 + \widehat{p2}\,w)(\widehat{p1}\,v - u) \\ (\widehat{p1}\,v - u)(\widehat{p2}\,w - t) \end{bmatrix}$$

The application of the gradient in direction of p to the filter polynomial $\hat{h}$ (n) in the deviation e(n)=x1(*n*)−$H_{all}$(n) *x2(*n*) then leads to the following update rule for the two adaptation parameters p1 and p2:

$$\hat{p}(n+1) = \hat{p}(n) - \frac{\mu}{2}\nabla_{\hat{p}(n)} e^2(n)$$

and thus, $$\hat{p}(n+1) = \hat{p}(n) - \mu e(n)\nabla_{\hat{p}(n)} e(n)$$

When writing down the directions of the two adaptation parameters p1, p2, and taking into account the deviation e(n)=x1(*n*)−$H_{all}$(n)*x2(*n*), this leads to $$p1(n+1) = p1(n) - \mu e(n)\nabla_{p1} e(n) = p1(n) - \mu e(n)\sum_{j=1}^{3}\frac{\partial \hat{h}_j(n)}{\partial p1}x_c(n-j-1)$$

$$p2(n+1) = p2(n) - \mu e(n)\nabla_{p2} e(n) = p2(n) - \mu e(n)\sum_{j=1}^{3}\frac{\partial \hat{h}_j(n)}{\partial p2}x_c(n-j-1)$$

with the signal $x_c(n)$ being the second microphone signal x2, filtered with the IIR filter contribution C in (discrete) time domain. The partial derivatives of the vector entries $\hat{h}_j(n)$ of the filter polynomial $\hat{h}$ (n) with respect to the adaptation parameters p1 and p2, respectively, can be derived from the form of the vector entries $\hat{h}_j(n)$ given above.

The update rules for the adaptation parameters in dependence on the IIR pre-filtered, second microphone signal $x_c(n)$ are obtained after normalization over the modulus square of the respective gradient with respect to p1 and p2, applied to e(n), as well as regularization by $e^2(n)$:

$$\widehat{p1}(n+1) = \widehat{p1}(n) + \mu e(n)\frac{v(1+\widehat{p2}(n)w)(x_c(n)+x_c(n-1)) + v(\widehat{p2}(n)w-t)(x_c(n-1)+x_c(n-2))}{|v(1+\widehat{p2}(n)w)(x_c(n)+x_c(n-1)) + v(\widehat{p2}(n)w-t)(x_c(n-1)+x_c(n-2))|^2 + |e(n)|^2}$$

$$\widehat{p2}(n+1) = \widehat{p2}(n) + \mu e(n)\frac{w(1+\widehat{p1}(n)v)(x_c(n)+x_c(n-1)) + w(\widehat{p1}(n)v-u)(x_c(n-1)+x_c(n-2))}{|w(1+\widehat{p1}(n)v)(x_c(n)+x_c(n-1)) + w(\widehat{p1}(n)v-u)(x_c)(n-1)+x_c(n-2))|^2 + |e(n)|^2}$$

In order to adjust the frequency responses, the first filter of FIG. 1 is applied to the second microphone signal x2 with a first value p1.0 for the first adaptation parameter p1, which preferably results from a convergence of the update rule given above for p1 (n→n+1). Likewise, the second filter H2 is applied to the second microphone signal x2 with a second value p2.0 for the second adaptation parameter p2, which preferably results from a convergence of the update rule given above for p2 (n→n+1).

For the implementation of the method, preferably an in-phase sound signal (c.f. the sound signal 22 in FIG. 1) is provided to the first microphone 1 and the second microphone 2 of FIG. 1, in order to perform the method using microphone signals x1, x2, which do not show any phase differences in their respective signal contributions themselves. The sound source for the in-phase sound signal 22 (i.e., the sound source is represented in the drawing by the pressure lines 22), which has an equal phase for both microphones 1, 2, is preferably located in the symmetry plane 24 of the two microphones 1, 2. In the case that the first microphone 1 and the second microphone 2 are parts of a hearing aid, the proposed method preferably is performed during a calibration, e.g., as part of the manufacturing process, while during normal operation, the first and second values p1.0, p2.0, as determined for the first and second adaptation parameter p1, p2 during said calibration, are used in the first and second filter H1, H2, respectively.

Even though the invention has been illustrated and described in detail with help of a preferred embodiment example, the invention is not restricted by this example. Other variations can be derived by a person skilled in the art without reaching beyond the protective scope of this invention.

The following is a summary list of reference numerals and the corresponding structure used in the above description of the invention:

1 first microphone
2 second microphone
4 first electroacoustic components
6 first electronic components
8 second electroacoustic components
10 second electronic components
12 first contribution (to differences of the phase responses)
14 electronic contribution
16 second contribution (to differences of the phase responses)
18 electroacoustic contribution
20 system
22 in-phase sound signal
24 symmetry plane
C IIR filter contribution
e(n) deviation
$e^2$ error function
H1 first filter
H2 second filter
$H_{all}$ global filter
$\hat{H}$ FIR filter contribution
$\hat{h}$ (n) filter polynomial (vector-valued)
$\hat{h}_j(n)$ filter polynomial (vector entry j)
HP1/HP2 first/second high-pass
Hcomp compensation filter
p1 first adaptation parameter
p1.0 first value
p2 second adaptation parameter
p2.0 second value
R reference signal
u, v, w, t parameter

The invention claimed is:

1. A method of adjusting respective phase responses of a first microphone and a second microphone, wherein the microphones are configured to generate first and second microphone signals, respectively, the method comprising:

determining a first filter for filtering the first microphone signal and/or the second microphone signal, the first filter corresponding to a first contribution to a difference of the phase responses between the first microphone and the second microphone and having a first adaptation parameter;

determining a second filter for filtering the first microphone signal and/or the second microphone signal, the second filter corresponding to a second contribution to the difference of the phase responses and having a second adaptation parameter;

determining a global filter from the first filter and the second filter, the global filter representing the first contribution and the second contribution to the difference of the phase responses, and the global filter including the first adaptation parameter and the second adaptation parameter;

determining with the global filter a first value for the first adaptation parameter and a second value for the second adaptation parameter by way of a multidimensional optimization; and with the first adaptation parameter of the first filter having the first value and the second adaptation parameter of the second filter having the second value, adjusting the phase responses by applying the first filter and the second filter to the first microphone signal and/or to the second microphone signal.

2. The method according to claim 1, which comprises:

determining the first filter such that the first contribution to the difference of the phase responses represents an electronic contribution to the phase responses; and/or determining the second filter such that the second contribution to the difference of the phase responses represents an electroacoustic contribution to the phase responses.

3. The method according to claim 1, which comprises:

supplying an in-phase sound signal having an equal phase with respect to the first microphone and the second microphone to the first microphone and/or to the second microphone, thereby generating a first test signal of the first microphone signal via the first microphone and/or a second test signal of the second microphone signal of the second microphone, respectively; and performing the multidimensional optimization with the first test signal and/or the second test signal, respectively.

4. The method according to claim 1, which comprises applying each of the first filter and the second filter to change only the first microphone signal.

5. The method according to claim 4, which comprises:

implementing the multidimensional optimization by way of a gradient descent algorithm; and applying a gradient with respect to a variation in direction of the first adaptation parameter and in direction of the second direction parameter to an error function, which is determined by way of a deviation of the second microphone signal, being filtered with the global filter, from a reference signal.

6. The method according to claim 5, which comprises using the first microphone signal as the reference signal for the deviation.

7. The method according to claim 5, which comprises:

forming the first filter and the second filter such that the global filter is divisible into an infinite impulse response filter contribution which is independent of the first adaptation parameter and the second adaptation parameter and a finite impulse response filter contribution;

constructing, with the finite impulse response filter contribution in time domain, a filter polynomial of the first adaptation parameter and the second adaptation parameter;

forming an update by updating the first value for the first adaptation parameter and/or the second value for the second adaptation parameter in the time domain; and constructing a step size of the update in dependence on the gradient applied to the filter polynomial.

8. The method according to claim 7, which comprises normalizing the step size in the respective direction of the first adaptation parameter and of the second adaptation parameter with respect to the deviation.

9. The method according to claim 8, which comprises regularizing a respective normalization in dependence on the error function.

10. The method according to claim 1, wherein the step of adjusting the phase responses further comprises using a parameter takes into account a different loudness sensitivity of the first microphone and the second microphone.

11. The method according to claim 1, which comprises adjusting the phase responses of two microphones of a hearing aid.

12. A system, comprising:

a first microphone configured to generate a first microphone signal and a second microphone configured to generate a second microphone signal;

a control unit connected to receive the first and second microphone signals and configured to perform the method according to claim 1 for adjusting the respective phase responses of the first microphone and the second microphone.

13. The system according to claim 12, further comprising a sound source configured to provide a diffuse sound signal and/or an in-phase sound signal to the first microphone and/or to the second microphone, said in-phase sound signal having an equal phase with respect to the first microphone and the second microphone.

14. The system according to claim 12, wherein the first microphone and the second microphone are disposed in a hearing aid.

* * * * *